US009462924B2

(12) United States Patent
Pyo et al.

(10) Patent No.: US 9,462,924 B2
(45) Date of Patent: Oct. 11, 2016

(54) DISHWASHER

(75) Inventors: Joonho Pyo, Seoul (KR); Moonkee Chung, Seoul (KR); Byeonghyeon Ju, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1189 days.

(21) Appl. No.: 13/469,570

(22) Filed: May 11, 2012

(65) Prior Publication Data

US 2012/0285495 A1 Nov. 15, 2012

(30) Foreign Application Priority Data

May 12, 2011 (KR) ..... 10-2011-0044517
May 12, 2011 (KR) ..... 10-2011-0044521

(51) Int. Cl.
*A47L 15/23* (2006.01)
*A47L 15/42* (2006.01)

(52) U.S. Cl.
CPC ..... *A47L 15/23* (2013.01); *A47L 15/4282* (2013.01)

(58) Field of Classification Search
CPC ..... A47L 15/23
See application file for complete search history.

(56) References Cited

U.S. PATENT DOCUMENTS 3,160,164 A 12/1964 Constance et al.
2010/0071735 A1* 3/2010 Kang ..... A47L 15/16 134/56 D

FOREIGN PATENT DOCUMENTS

| | | |
|---|---|---|
| DE | 2143111 | 4/1972 |
| DE | 3816408 | 11/1989 |
| DE | 10 2006 012 080 | 9/2007 |
| EP | 1 040 786 | 10/2000 |
| WO | WO 2008/072901 | 6/2008 |

OTHER PUBLICATIONS

European Search Report dated Sep. 21, 2012.

* cited by examiner

*Primary Examiner* — Michael Barr
*Assistant Examiner* — Jason Riggleman
(74) *Attorney, Agent, or Firm* — Ked & Associates LLP

(57) ABSTRACT

The present invention relates to a flow passage change-over unit provided to a spray arm of a dishwasher having a plurality of channels, including a change-over unit body for making reciprocating movement according to a water pressure, a body rotating unit secured to an circumferential surface of the change-over unit body for rotating the change-over unit body, and channel opening holes in a closed side of the change-over unit body for opening some of the plurality of supply holes according to a rotation angle of the change-over unit body.

12 Claims, 11 Drawing Sheets

(a)

(b)

DISHWASHER

CROSS REFERENCE TO RELATED APPLICATION

This application claims the benefit of the Patent Korean Application No. 10-2011-0044521, filed on May 12, 2011, and Korean Application No. 10-2011-0044517, filed on May 12, 2011, which are hereby incorporated by reference as if fully set forth herein.

BACKGROUND OF THE DISCLOSURE

1. Field of the Disclosure

The present invention relates to a dishwasher.

2. Discussion of the Related Art

The dishwasher is a machine for washing dirt, such as food draff, from tableware or cooking utensils (Hereafter will be called as a 'washing object') with detergent and washing water.

A general dishwasher is provided with a tub for providing a washing space, a dish rack in the tub for holding the washing object, a spray arm for spraying the washing water to the rack, a sump for holding the washing water, and a supply flow passage for supplying the washing water from the sump to the spray arm.

The dishwasher described above can remove the dirt from the washing object by spraying the washing water to the washing object in the rack according to a washing course the user selects, and dry the washing object having the dirt removed therefrom thus with hot air.

A related art dishwasher has a structure in which a rotation direction of a spray arm is fixed as the washing water is sprayed from spray holes in the spray arm, and the spray arm has only one washing water flow passage (Channel) in the spray arm for supplying the washing water to the spray holes. Therefore, the related art dishwasher has the spray arm rotated only in one direction, and, since the spray arm always rotates in one direction thus, a direction of spray of the washing water being sprayed to the washing object can not but be fixed, too.

Due to this, the related art dishwasher has a problem of poor cleaning power.

In order to solve the problem, though there has been a dishwasher which changes the rotation direction of the spray arm with a driving unit, such as a motor, the dishwasher which changes the rotation direction of the spray arm with the driving unit has a problem in that the driving unit is susceptible to leakage of water, and a problem in that management is required for maintaining durability.

SUMMARY OF THE DISCLOSURE

An object of the present invention, devised to solve the problems, is to provide a dishwasher having improved cleaning power.

For this, the present invention is to provide a dishwasher having a plurality of washing water flow passages (Channels) provided to a spray arm which sprays the washing water to change a direction of spray of the washing water at the time of spray of the washing water.

And, the present invention is to provide a dishwasher which can change the direction of spray of the washing water with a flow passage change-over unit which makes selective opening of a plurality of washing water flow passages (Channels), and can change a rotation direction of a spray arm without a separate driving unit.

And, the present invention is to provide a dishwasher which enables to prevent foreign matter from remaining at a flow passage change-over unit, to prevent a performance of the flow passage change-over unit from becoming poor.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher includes a tub for providing a space for holding a washing object, a spray arm having a plurality of channels for flow of the washing water, a plurality of supply holes for introducing the washing water to the plurality of channels, and spray holes for spraying the washing water introduced to the channels thus toward the washing object, a chamber in communication with the plurality of supply holes, an upper coupling portion and a lower coupling portion provided to an upper side and a lower side of the chamber respectively, a washing water supply unit for supplying the washing water to the chamber, and a flow passage change-over unit provided in the chamber, wherein the flow passage change-over unit has a change-over unit body having a cylindrical shape with an opened side and a closed side for making reciprocating movement in the chamber according to a water pressure of the washing water being introduced to an inside of the chamber, a body rotating unit secured to an circumferential surface of the change-over unit body, for coupling to the upper coupling portion or the lower coupling portion to rotate the change-over unit body, and channel opening holes in the closed side for opening some of the plurality of supply holes according to a rotation angle of the change-over unit body.

The flow passage change-over unit may further include a first slit provided to pass through the change-over unit body for introducing the washing water moving between an inside circumferential surface of the chamber and the body rotating unit to an inside of the change-over unit body.

And, the flow passage change-over unit may further include a second slit provided between the change-over unit body and the body rotating unit for enabling flow of the washing water.

The first slit may be provided to be connected to an outside circumferential surface of the channel opening holes at a position higher than the second slit.

And, a straight line passing through a rotation center of the change-over unit body and a center of the first slit may be at a predetermined angle from a straight line passing through the rotation center of the change-over unit body and a center of the second slit.

The change-over unit body may have a top side provided at the same height with a top side of the body rotating unit.

And, the body rotating unit may be provided to have a cylindrical shape and to be in contact with an inside circumferential surface of the chamber to guide reciprocating movement of the change-over unit body, and further may include upper projections to be coupled to the upper coupling portion for rotating the change-over unit body, and lower projections to be coupled to the lower coupling portion for rotating the change-over unit body.

And, the change-over unit body may have a sloped surface at an upper side of an outside circumference thereof, and the chamber may further include a chamber sloped surface for receiving the sloped surface when the upper projections couple to the upper coupling portion.

Moreover, in another aspect of the present invention, a dishwasher includes a tub for providing a space for holding a washing object, a spray arm having a plurality of channels for selective flow of the washing water, a plurality of supply holes for introducing the washing water to the plurality of channels, and spray holes for spraying the washing water introduced to the channels thus toward the washing object, a chamber positioned on an underside of the spray arm to be in communication with the plurality of supply holes, a flow passage guider having one end positioned in the chamber passed through the spray arm and the other end positioned on an upper side of the spray arm, a washing water supply unit connected to the other end of the flow passage guider for supplying the washing water to the chamber, and a flow passage change-over unit provided in the chamber, wherein the flow passage change-over unit includes, a change-over unit body having a cylindrical shape with an opened side and a closed side for making reciprocating movement and rotating movement in the chamber according to a water pressure in the chamber, a change-over unit pass through hole in the closed side for placing the flow passage guider therethrough, and channel opening holes in the closed side for opening some of the plurality of supply holes according to a rotation angle of the change-over unit body.

The chamber may further include an upper coupling portion provided to an upper side of the chamber, and a lower coupling portion provided to a bottom of the chamber, the flow passage change-over unit may further include a body rotating unit having a cylindrical shape with opened upper side and lower side, the body rotating unit secured to a circumferential surface of the change-over unit body, and the body rotating unit may include upper projections to be coupled to the upper coupling portion for rotating the change-over unit body, and lower projections to be coupled to the lower coupling portion for rotating the change-over unit body.

The flow passage change-over unit may further include a first slit provided to pass through the change-over unit body for introducing the washing water moving between an inside circumferential surface of the chamber and an outside circumferential surface of the body rotating unit to an inside of the change-over unit body.

The flow passage change-over unit may further include a second slit provided between an outside circumferential surface of the change-over unit body and an inside circumferential surface of the body rotating unit for enabling flow of the washing water.

And, a straight line passing through a rotation center of the change-over unit body and a center of the first slit is at a predetermined angle from a straight line passing through the rotation center of the change-over unit body and a center of the second slit.

And, the spray arm may further include a arm pass through hole passing through the flow passage guider, the plurality of supply holes may be provided along a circumferential surface of the arm pass through hole, and the channel opening holes may be provided along a circumferential surface of the change-over unit pass through hole.

And, the flow passage guider may include a hollow pipe placed in the arm pass through hole and the change-over unit pass through hole, the hollow pipe connected to the bottom of the chamber, and a discharge hole provided to pass through the hollow pipe for supplying the washing water to the chamber.

The flow passage guider may further include a body supporting portion provided to an outside circumferential surface of the hollow pipe to support the change-over unit body for positioning the closed side of the change-over unit body to be above the discharge hole.

And, the dishwasher may further include a discharge guider at the bottom of the chamber for guiding the washing water in the hollow pipe toward the discharge hole.

And, the discharge guider may have a conical shape with a peak point positioned at a center of the hollow pipe.

And, the dishwasher may further include a remained water drain pipe provided at a bottom of the chamber for making an inside of the chamber in communication with an outside of the chamber.

The remained water drain pipe has bends.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings.

The terms in this specification have been selected only for description of the embodiments, but not for limiting subject matters of the present invention with meanings of the terms themselves. However, as far as there is no specific definition, all terms in the specification are the same with a general meaning of the term understood by persons skilled in this field of art, and, if the term used in the specification conflicts with the general meaning of the term, the meaning of the term used in the specification prevails.

A singular expression in this specification contains a plural expression as far as the singular expression is not singular in view of a context of a passage, obviously. And, it is required to interpret that a word, such as "configure" or "include", may include additional elements or steps.

And, since a term including an ordinal number, such as first or second, is used only for making one element distinctive from other elements, as far as functions of elements are defined clearly, a first element may be named as a second element, and a second element may also be named as a first element.

In the meantime, a configuration or a control method of a device described hereinafter is provided only for describing embodiments of the present invention, but not for limiting scope of patent rights of the present invention. Wherever possible, the same reference numbers will be used throughout the drawings to refer to the same or like parts.

Figure 1:
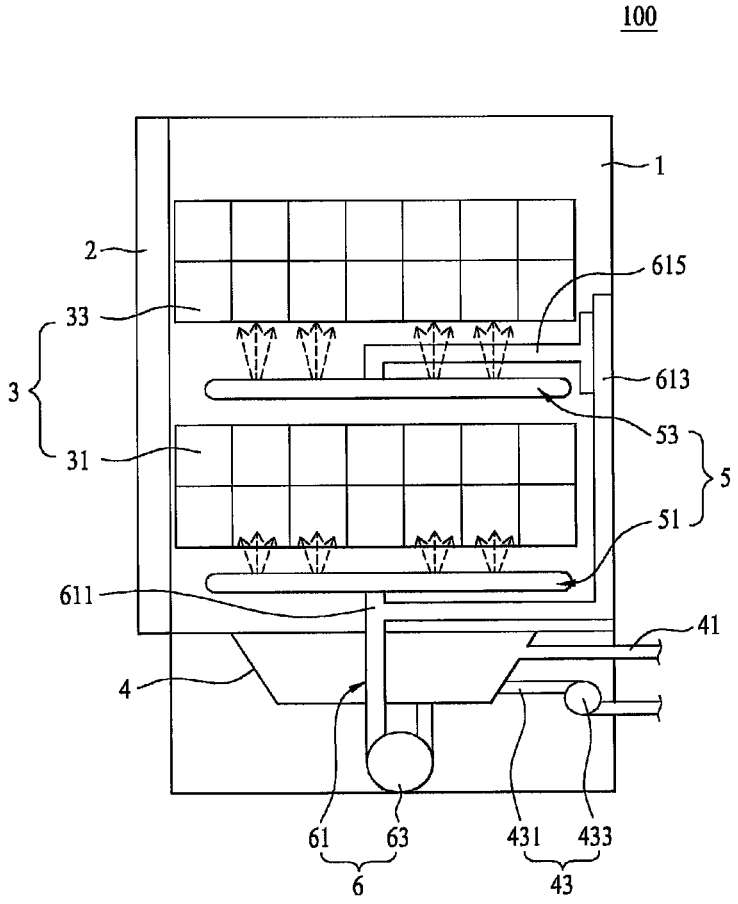
FIG. 1 illustrates a schematic view of a dishwasher.

Referring to FIG. 1, the dishwasher 100 includes a tub 1 for providing a washing space, a door 2 for selective opening/closing of the washing space, and a rack 3 in the tub for holding washing objects.

Since the rack 3 is provided to be drawable in a front direction of the tub 1 when the door 2 is opened, a user can draw the rack 3 in the front direction of the tub for placing or taking the washing object in or out of the washing space.

The rack 3 may be provided to be at least two or more than two. That is, the rack 3 may be provided with a first rack (Lower rack) 31 positioned on a lower side of the tub, and a second rack (Upper rack) 33 positioned over the lower rack 31.

In the meantime, there may be a sump 4 under the tub 1 for holding washing water required for washing the washing object, additionally.

The sump 4 has the washing water supplied thereto through a sump water supply unit 41 which may be a water supply hose that makes a water supply source (Not shown) provided to an outside of the dishwasher 100 and the sump 4 to be in communication.

And, the sump 4 may be provided with a sump drain unit 43 for draining the washing water from the sump to an outside of the sump, additionally. The sump drain unit 43 may be provided as a drain hose 431 for making the sump in communication with the outside of the dishwasher and a drain pump 433 provided to the drain hose.

And, the dishwasher 100 includes a spray arm 5 in the tub 1 for spraying the washing water to the washing object in the rack 3.

If the rack 3 has the lower rack 31 and the upper rack 33, the spray arm 5 may be provided as a first spray arm (Lower arm) 51 for spraying the washing water to the lower rack 31 and a second spray arm (Upper arm) 53 for spraying the washing water to the upper rack 33.

The spray arm 5 may be provided to spray the washing water being supplied thereto from the water supply source provided to an outside of the dishwasher 100 to the washing object directly, or, as shown in FIG. 1, to spray the washing water held in the sump 4 to the washing object in the rack.

In a case the spray arm 5 is provided to spray the washing water held in the sump 4 to the washing object, the spray arm 5 is in communication with the sump 4 through a washing water supply unit 6.

That is, the washing water supply unit 6 may include a supply flow passage 61 connected between the sump 4 and the spray arm 5, and a supply pump 63 for moving the washing water from the sump 4 to the supply flow passage 61.

In this case, the supply flow passage 61 may have a first flow passage 611 connected between the sump 4 and the lower arm 51, and a second flow passage 613 connected between the sump 4 and the upper arm 53.

The second flow passage 613 may be provided as a branch from the first flow passage 611 or the upper arm 53 may be provided to have the washing water supplied thereto through a detachable pipe 615 to/from the second flow passage 613, of which details will be described, later.

A structure of the first spray arm (Lower arm) 51 will be described with reference to FIG. 2.

The lower arm 51 includes a lower arm first body 511 and a lower arm second body 513 each for forming at least two channels 515 and 517 for selective flow of the washing water, and a chamber 518 (Hereinafter called as a first chamber 518 for making the chamber 518 distinctive from an upper arm chamber 539 to be described later) for receiving the washing water from the first flow passage 611 and supplying the washing water to the channel 515 or 517.

Figure 2:
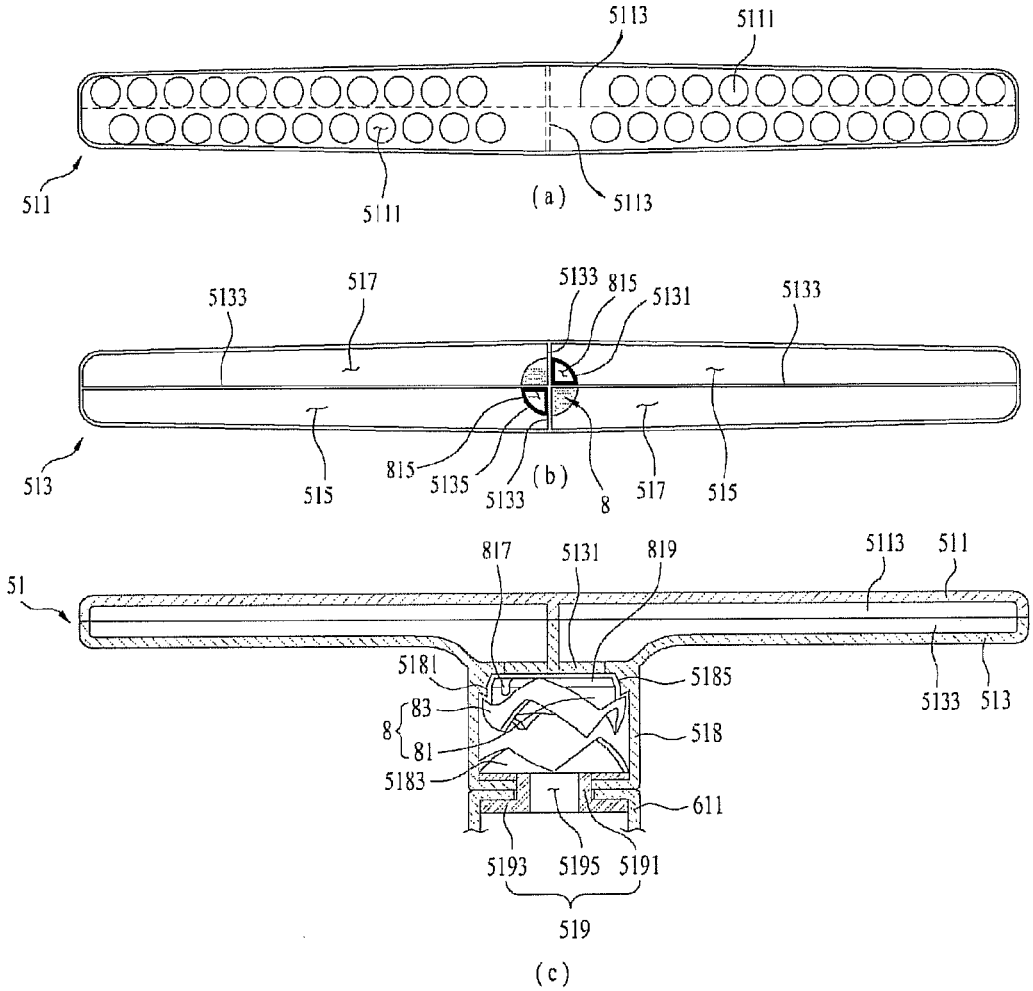
FIG. 2 illustrates schematic views of a spray arm (First spray arm) in accordance with a preferred embodiment of the present invention.

FIG. 2 illustrates a case in which the lower arm 51 has a first channel 515 (Hereinafter called as a lower arm first channel 515 for making the first channel 515 distinctive from an upper arm first channel 535 to be described later) and a second channel (Hereinafter called as a lower arm second channel 517 for making the second channel 517 distinctive from an upper arm second channel 537 to be described later).

In this case, the channels 515 and 517 may be formed by partition walls provided to any one of the lower arm first body 511 or the lower arm second body 513, or, as shown in FIG. 2, by coupling of an upper side partition wall 5113 of the lower arm first body 511 and a lower side partition wall 5133 of the lower arm second body 513.

The lower arm second body 513 has a supply hole 5131 (Hereafter called as a lower arm supply hole 5131 for making the supply hole 5131 distinctive from an upper arm supply hole 5331 to be described later) for making the channels 515 and the 517 in communication with the first chamber 518, additionally.

And, the lower arm first body 511 has spray holes 5111 for discharging the washing water introduced to the channels 515 and 517 to an outside of the channels additionally. The washing water discharged through the spray holes 5111 is sprayed to the washing object held in the lower rack 31.

The first chamber 518 has a cylindrical shape fixedly secured to an underside of the second body 513. It is preferable that the lower arm supply hole 5131 provided to the lower arm second body 513 is positioned in the first chamber 518.

Therefore, the washing water introduced to the first chamber 518 through the first flow passage 611 is supplied to the channels 515 and 517 in the lower arm 51 through the lower arm supply hole 5131.

In the meantime, the spray holes 5111 may be provided such that the washing water is discharged perpendicular to an upper side of the lower arm first body 511 or a discharge angle of the washing water being discharged through the spray holes 5111 is at an acute angle from the upper side of the first body 511.

If the spray holes is provided such that the discharge angle of the washing water is at an acute angle from the upper side of the lower arm first body 511, and the lower arm 51 is rotatably coupled to the first flow passage 611, since the lower arm 51 can rotate owing to the repelling power occurred when the washing water is sprayed, washing efficiency can be improved.

For this, the lower arm 51 may include a supporter 519 for rotatably securing the first chamber 518 to the first flow passage 611, additionally.

Referring to FIG. 2C, the supporter 519 includes a cylindrical support pipe 5191 fixedly secured to the first chamber 518, a supporter flange 5193 around an outside circumference of the support pipe positioned within the first flow passage 611, and a washing water introduction hole 5195 passed through the support pipe 5191.

According to this, the lower arm 51 is rotatably secured to the first flow passage 611 with the supporter flange 5193, the washing water being supplied through the first flow passage 611 is supplied to an inside of the first chamber 518 through the washing water introduction hole 5195, and the washing water introduced to the inside of the first chamber 518 is supplied to the channel 515 or 517 in the lower arm 51 through the lower arm supply hole 5131.

Provided in the first chamber 518, there is a flow passage change-over unit 8 (Hereafter called as a first flow passage change-over unit 8 for making the flow passage change-over unit 8 distinctive from an upper arm flow passage change-over unit 9 to be described later) for making reciprocating movement and rotating movement according to a water pressure in the first chamber to open some of a plurality of the lower arm supply holes 5131.

Though the first flow passage change-over unit 8 may be provided to be rotatable by a separate rotating member, the first flow passage change-over unit 8 may also be provided to be rotatable by the water pressure of the washing water introduced to the first chamber 518 through the first flow passage 611 and the washing water introduction hole 5195.

If the first flow passage change-over unit 8 is provided to be rotatable by the water pressure of the washing water introduced to the first chamber, the first flow passage change-over unit 8 includes a change-over unit body 81 (Hereafter called as a first change-over unit body 81 for making the change-over unit body 81 distinctive from a change-over body 91 provided to the second flow passage change-over unit to be described later) for making linear reciprocating movement within the first chamber 518, and a body rotating unit 83 (Hereafter called as a first body rotating unit 83 for making the body rotating unit 83 distinctive from a body rotating unit 93 provided to the second flow passage change-over unit to be described later).

Figure 3:
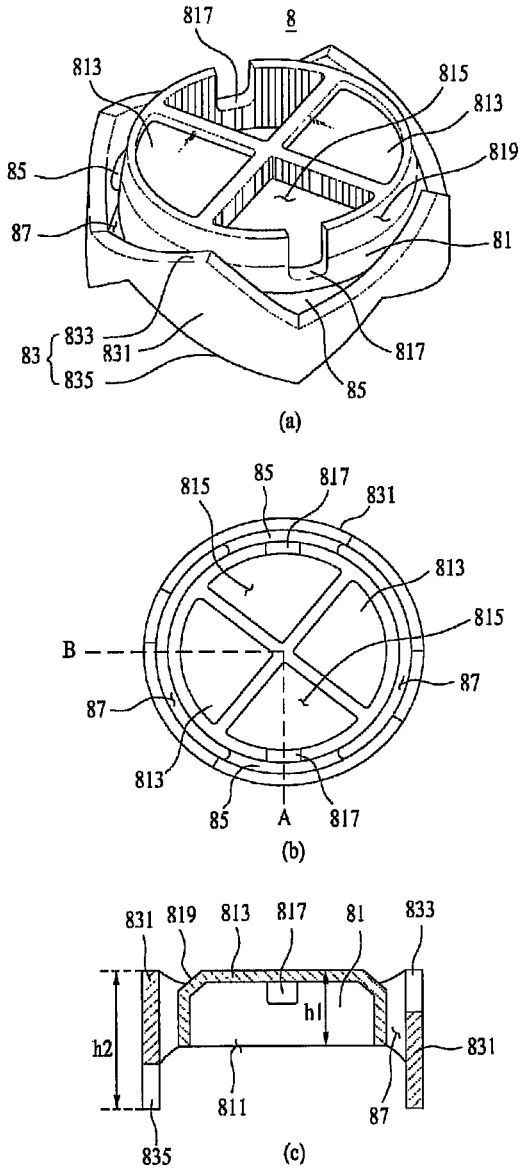
FIG. 3 illustrates schematic views of a flow passage change-over unit (First flow passage change-over unit) in the spray arm in FIG. 2.

Referring to FIG. 3, it is preferable that the first change-over unit body 81 is provided to have a cylindrical shape with an opened side 811 (See FIG. 5) and a closed side 813 for moving toward the lower arm 51 if the water pressure in the first chamber 518 is high (Introduction of the washing water into the first chamber), and moving away from the lower arm 51 (Toward the first flow passage 611) if the water pressure in the first chamber 518 is low (No introduction of the washing water to the first chamber).

That is, if the dishwasher 100 has a structure in which the washing water is introduced to the first chamber 518 from an underside thereof, the opened side 811 may be provided to the underside of the first change-over unit body 81.

In the meantime, referring to FIG. 3, the closed side 813 has channel opening holes 815 each having a shape in conformity with the lower arm supply hole 5131 in the lower arm 51.

It is preferable that the channel opening holes 815 are provided to open some of the plurality of the lower arm supply holes 5131, only.

Figure 4:
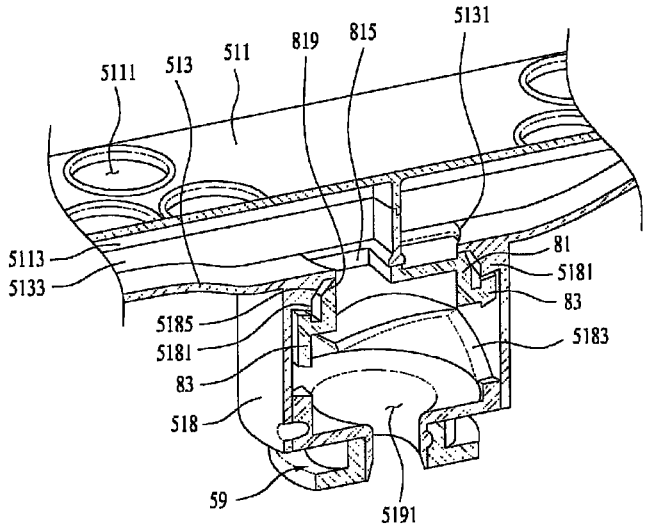
FIGS. 4 and 5 illustrate schematic views showing the steps of operation of the spray arm in FIG. 2.
Figure 4:
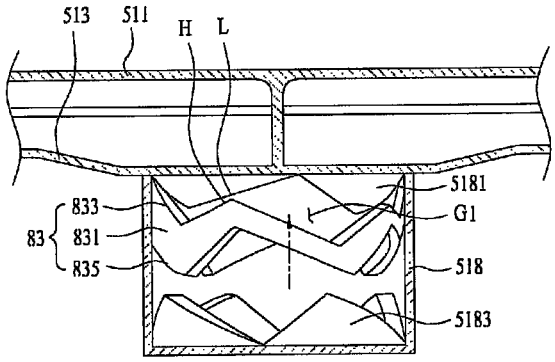

That is, a number of the channel opening holes 815 may be different from a number of the lower arm supply holes 5131. If four lower arm supply holes 5131 are provided to the lower arm second body 513 spaced at 90° intervals as shown in FIG. 2B, the closed side 813 may have two channel opening holes 815 spaced at 180° intervals as shown in FIG. 4.

In the meantime, the first body rotating unit 83 is fixedly secured to the first change-over unit body 81 to rotate the first change-over unit body 81 as the first body rotating unit 83 is coupled to an upper coupling portion 5181 (See FIG. 4) or a lower coupling portion 5183 according to the water pressure in the first chamber 518.

That is, the first body rotating unit 83 having a cylindrical shape with opened upper and lower sides may include a rotating unit body 831 fixedly secured to a circumferential surface of the first change-over unit body 81, upper projections 833 projected upward from the rotating unit body 831, and lower projections 835 projected downward from the rotating unit body 831.

The rotating unit body 831 is provided to be in contact with an inside circumferential surface of the first chamber 518 for guiding the reciprocating movement of the first change-over unit body 81.

Referring to FIG. 3C, though the rotating unit body 831 may have a height h2 the same with a height h1 of the first change-over unit body 81, the rotating unit body may have a height h2 higher than a height h1 of the first change-over unit body.

However, if the height h2 of the rotating unit body is higher than the height h1 of the first change-over unit body, it is preferable that the rotating unit body 831 has a top side positioned the same with a top side of the first change-over unit body 81.

This is for minimizing a volume of the first chamber 518 to utilize the washing space the tub 1 provides to the maximum.

The first chamber 518 has a size dependent on sizes of the rotating unit body 831 and the first change-over unit body 81, and, if the size of the first chamber 518 becomes larger, raising a height of the lower arm 51, the space in the tub 1 becomes smaller.

Therefore, if the height h2 of the rotating unit body is made the same with the height h1 of the first change-over unit body, or the top side of the rotating unit body 831 is made to be positioned the same with the top side the first change-over unit body 81, above problem can be solved.

In the meantime, the upper projections 833 couple to the upper coupling portion 5181 (Hereafter called as a first chamber upper coupling portion 5181 for making the upper coupling portion 5181 distinctive from an upper coupling portion 5391 provided to the upper arm to be described later) provided on an upper side of the first chamber 518, and the lower projections 835 couple to the lower coupling portion 5183 (Hereafter called as a first chamber lower coupling portion 5183 for making the lower coupling portion 5183 distinctive from a lower coupling portion 5393 provided to the upper arm to be described later) provided on a lower side of the first chamber 518.

That is, if the water pressure of an inside of the first chamber is high, the first change-over unit body 81 moves toward the lower arm 51, in which course, if the upper projections 833 couple to the first chamber upper coupling portion 5181, the first change-over unit body 81 rotates in a clockwise direction (Or, counter clockwise direction).

And, if the water pressure of the inside of the first chamber is low, the first change-over unit body 81 moves toward a bottom of the first chamber 518, in which course, if the lower projections 835 couple to the first chamber lower coupling portion 5183, the first change-over unit body 81 rotates in the clockwise direction.

For this, referring to FIG. 4, it is preferable that a shape of the first chamber upper coupling portion 5181 and shapes of the upper projections 833 have gear tooth shapes which are engagable to each other. And, it is preferable that the shape of the first chamber upper coupling portion 5181 and the shapes of the upper projections 833 are provided such that the first change-over unit body 81 is rotated by a predetermined angle when the first chamber upper coupling portion 5181 and the upper projections 833 couple together.

That is, it is preferable that the shape of the first chamber upper coupling portion 5181 and the shape of the upper projections 833 are provided such that the first change-over unit body 81 is rotated in a course peak points H of the upper projections 833 move along oblique sides L of the first chamber upper coupling portion 5181 in a case the first change-over unit body 81 moves toward the lower arm 51.

And, it is preferable that shapes of the first chamber lower coupling portion 5183 and the lower projections 835 also have the gear tooth shapes which are engagable to each other such that the first change-over unit body 81 is rotated by a predetermined angle in a course of coupling of the first chamber lower coupling portion 5183 to the lower projections.

In the meantime, it is preferable that, in a case the two channel opening holes 815 spaced at 180° intervals open the four lower arm supply holes 5131 spaced at 90° intervals in succession, the first change-over unit body 81 is rotated by 45° in the counter clockwise direction when the first chamber upper coupling portion 5181 couple to the upper projections 833, and the first change-over unit body 81 is rotated by 45° in the counter clockwise direction further when the first chamber lower coupling portion 5183 couple to the lower projections 833.

In this case, if the washing water is introduced to the inside of the first chamber 518 through the first flow passage 611 (If the water pressure inside of the first chamber becomes higher), since the first change-over unit body 81 moves toward the lower arm 51 along the inside wall of the first chamber 518 until the upper projections 833 couple to the first chamber upper coupling portion 5181 when the first change-over unit body 81 rotates by 45° in the counter clockwise direction, the channel opening holes 815 open some of the plurality of lower arm supply holes 5131.

Then, if the supply pump 63 interrupts the washing water supply to the first flow passage 611 (If the water pressure inside of the first chamber becomes lower), the first change-over unit body 81 moves toward the bottom of the first chamber (A direction moving away from the lower body), and the first change-over unit body 81 rotates by 45° in the counter clockwise direction as the lower projections 835 couple to the lower coupling portion 5183.

Since the counter clockwise direction rotation of the first change-over unit body 81 is no more than a rotation direction set freely for convenience of description, shapes of the first body rotating unit 83, the first chamber upper coupling portion 5181, and the first chamber lower coupling portion 5183 may be designed to make the first change-over unit body 81 to rotate in the clockwise direction.

In the meantime, there is a gap, such as tolerance required in design, between the inside circumferential surface of the first chamber 518 and the outside circumferential surface of the first flow passage change-over unit 8.

Therefore, the dishwasher only having above elements is liable to have foreign matter remained between the inside circumference of the first chamber 518 and the outside circumferential surface of the first flow passage change-over unit 8 to interfere the reciprocating movement and the rotation movement of the first flow passage change-over unit 8.

That is, the washing water the washing water supply unit 6 supplies to the first chamber 518 is the washing water held in the sump 4. The sump 4 collects the washing water the spray arm 5 sprays to the washing object during dish washing.

Accordingly, as the dish washing progresses, the washing water collected at the sump becomes to have an increased amount of the dirt removed from the washing object, and the dirt contained in the washing water may remain on the inside circumferential surface of the first chamber or the outside circumferential surface of the first flow passage change-over unit in a course the washing water flows through a space between the first body rotating unit 83 and the first chamber 518.

In order to solve above problem, the first flow passage change-over unit 8 includes a first slit 817 (See FIG. 3) provided to pass through the first change-over unit body 81, additionally.

The first slit 817 may be provided along a height direction or a circumferential direction of the first change-over unit body 81 for making an inside of the first change-over unit body 81 to be in communication with an outside of the first change-over unit body 81.

In this case, the first slit 817 may be provided to be connected to an outside circumferential surface of the channel opening hole 815.

Therefore, referring to FIG. 5B, since the washing water F1 moving through a space between the outside circumferential surface of the first body rotating unit 83 and the inside circumferential surface of the first chamber 518 is introduced to an inside of the lower arm 51 through a space G1 (See FIG. 4B), the first slit 817 between the upper projections 833 and the first chamber upper coupling portion 5181, remaining of the foreign matter contained in the washing water at the first chamber 518 or the first flow passage change-over unit 8 can be prevented.

In the meantime, the space G1 (See FIG. 3B) between the first chamber upper coupling portion 5181 and the upper projections 833 disappears if the upper projections 833 couple to the first chamber upper coupling portion 5181 perfectly. In this case, the foreign matter is liable to remain at the first chamber 518 or the first flow passage change-over unit 8.

Therefore, a shape of the first chamber upper coupling portion 5181 and shapes of the upper projections 833 may be provided to form a space which allows a flow of the washing water even in a case the first chamber upper coupling portion 5181 couples to the upper projections 833, perfectly.

Moreover, the first flow passage change-over unit 8 may include a second slit 87 for preventing the foreign matter from remaining at the outside circumferential surface of the first change-over unit body 81, additionally.

Referring to FIG. 3, the second slit 87 may be provided between the outside circumferential surface of the first change-over unit body 81 and the first body rotating unit 83.

That is, the second slit 87 may be defined as a space formed between the rotating unit body 831 of the first body rotating unit 83 and the outside circumferential surface of the first change-over unit body 81. In this case, it is preferable that the rotating unit body 831 is secured to the outside circumferential surface of the first change-over unit body 81 with a fastening rib 85.

In the meantime, it is preferable that a straight line A passing through a center of the first slit 87 and the rotation center of the first change-over unit body 81 is at a predetermined angle from a straight line B passing through a center of the second slit 87 and the rotation center of the first change-over unit body 81.

This is for making the washing water to remove the foreign matter from the outside circumferential surface of the first change-over unit body 81 by making the washing water passed through the second slit 87 to move along the circumferential surface of the first change-over unit body 81, and, therefrom, to be introduced to an inside of the first change-over unit body 81 through the first slit 817.

In the meantime, the first change-over unit body 81 has a sloped side 819 on an upper side, and the first chamber 518 may include a chamber sloped side 5185 (Hereafter called as a first chamber sloped side 5185 for making the chamber sloped side 5185 distinctive from a chamber sloped side 5595 provided to an upper side of the upper arm to be described later) on an upper side of the first chamber 518 for receiving the sloped side 819, additionally.

The sloped side 819 and the first chamber sloped side 5185 are a configuration for making communication between the channel opening holes 815 and the lower arm supply hole 5131 easy. It is preferable that the sloped side 819 is provided along the upper side of the outside circumferential surface of the first change-over unit body 81, and the first chamber sloped side 5185 is provided between the first chamber upper coupling portion 5181 and the lower arm supply hole 5131.

In the meantime, the sloped side 819 may be provided to an upper side of an outside circumferential surface of the rotating unit body 831. In this case, it is preferable that the first chamber sloped side 5185 is provided to an upper side of an inside circumferential surface of the first chamber 518.

Figure 5:
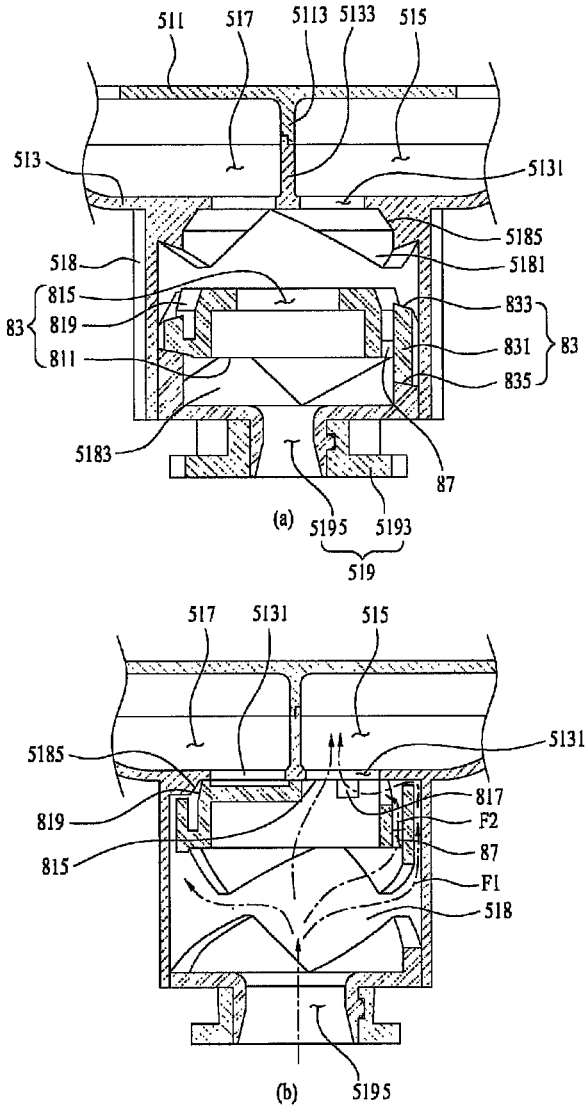

The operation of the first flow passage change-over unit 8 will be described with reference to FIG. 5.

Since the washing water is not supplied to the inside of the first chamber 518 from the sump 4 if the supply pump 63 is not in operation, the lower projections 835 at the first flow passage change-over unit 8 maintain a coupled state to the lower coupling portion 5183 (FIG. 5A).

If the supply pump 63 is put into operation to supply the washing water to the inside of the first chamber 518, introducing the washing water to an inside of the opened side 811 of the first change-over unit body 81, the first flow passage change-over unit 8 moves toward the lower arm 51.

Since the first change-over unit body 81 has a cylindrical shape with the opened side, if the washing water is supplied to the first chamber, the first change-over unit body 81 will be quickly movable toward the lower arm 51.

If the first flow passage change-over unit 8 moves toward the lower arm 51, since the upper projections 833 of the first body rotating unit 83 couple to the first chamber upper coupling portion 5181 and rotate the first change-over unit body 81 by 45°, the two channel opening holes 815 in the closed side 813 of the first change-over unit body open the two lower arm supply holes 5131 spaced at 180° intervals in the four lower arm supply holes 5131 spaced at 90° intervals (To supply the washing water to either one of the lower arm first channel and the lower arm second channel).

In this case, since the sloped side 819 at the first change-over unit body 81 couples to the first chamber sloped side 5185 at the first chamber 518, the channel opening holes 815 can open some of the lower arm supply holes 5131, completely.

Thereafter, if the washing water is supplied to the first chamber 518 again, the first flow passage change-over unit 8 moves toward the upper side of the first chamber 518 to open the lower arm supply holes 5131 which are not opened, before.

Therefore, the dishwasher of the present invention can improve cleaning power of the dishwasher owing to the alternated washing water spray with the plurality of channels provided to the lower arm 51, enabling to vary a spray angle of the washing water being sprayed to the washing object.

By using above course, the first flow passage change-over unit 8 supplies the washing water being supplied from the supply pump 63 to the lower arm first channel 515 and the lower arm second channel 517 in succession, such that the washing water being supplied to the channels is sprayed to the washing object through the spray holes 5111 in the lower arm first body 511.

And, it is possible to provide a spray direction of the washing water from the spray holes 5111 in communication with the lower arm first channel 515 is opposite to the spray direction of the washing water from the spray holes 5111 in communication with the lower arm second channel 517, which has an effect of changing the rotation direction of the lower arm 51 when the washing water is supplied to the channels 515 and 517 alternately through the first flow passage change-over unit 8.

If it is assumed that the spray holes 5111 are provided such that the spray angle of the washing water being discharged from the spray holes 5111 is made to be at an acute angle from an upper side of the lower arm first body 511, wherein the spray holes 5111 in communication with the lower arm first channel 515 is provided to rotate the lower arm in a clockwise direction, and the spray holes 5111 in communication with the lower arm second channel 517 is provided to rotate the lower arm in a counter clockwise direction.

In this case, if the washing water is supplied to the lower arm first channel 515, the lower arm 51 rotates in the clockwise direction by repelling power of the washing water being discharged from the spray holes 5111, and if the washing water is supplied to the lower arm second channel 517, the lower arm 51 rotates in the counter clockwise direction by repelling power of the washing water being discharged from the spray holes 5111, thereby enabling the dishwasher of the present invention to vary the spray direction and the spray angle of the washing water.

In the meantime, since a portion of the washing water introduced to the first chamber 518 moves F1 along the space between the outside circumferential surface of the first body rotating unit 83 and the inside circumferential surface of the first chamber 518, and is introduced to the inside of the lower arm 51 through the space G1, the first slit 817 between the upper coupling portion 5181 and the upper projections 833, the remaining of the foreign matter on the inside circumferential surface of the first chamber 518 can be prevented.

And, since a portion of the washing water introduced to the first chamber 518 passes F2 through the second slit 87 and, therefrom, moves to the inside of the lower arm 51 through the first slit 817, the remaining of the foreign matter on the outside circumferential surface of the first change-over unit body 81 can also be prevented.

Figure 6:
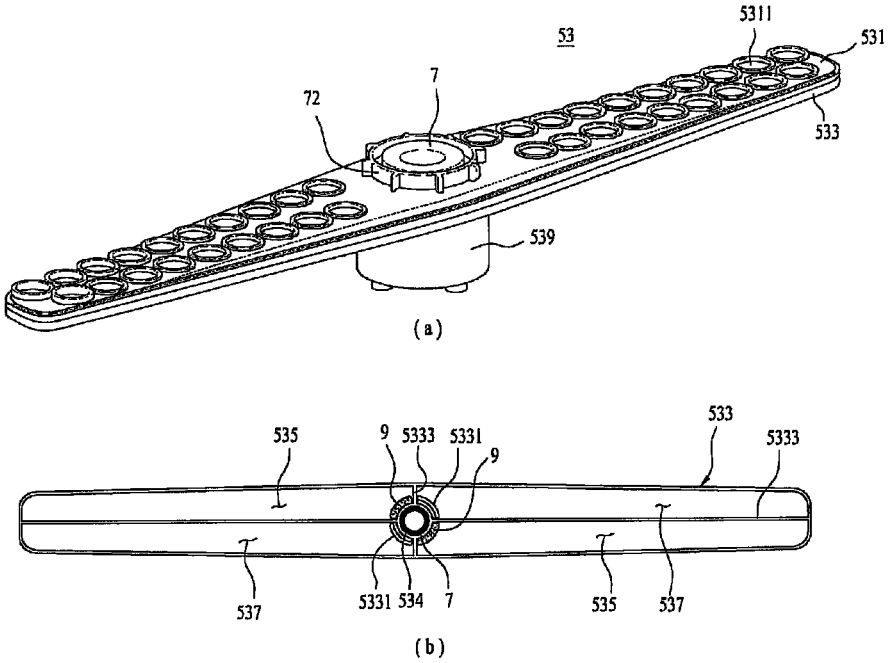
FIGS. 6 to 8 illustrate schematic views of a spray arm (Second spray arm) in accordance with another preferred embodiment of the present invention.

The second spray arm (Upper arm) 53 will be described with reference to FIG. 6.

The upper arm 53 includes an upper arm first body 531 having sprays holes 5311 provided therein, an upper arm second body 533 provided on an underside of the upper arm first body 531 to have a plurality of channels 535 and 537 provided for selective flow of the washing water, and a second chamber 539 provided on an underside of the upper arm second body 533 to be in communication with the plurality of channels.

Provided between the upper arm first body 531 and the upper arm second body 533, there is a partition wall 5333 to form an upper arm first channel 535 and an upper arm second channel 537, and the upper arm second body 533 has upper arm supply holes 5331 to make the channels in communication with the second chamber 539.

Figure 7:
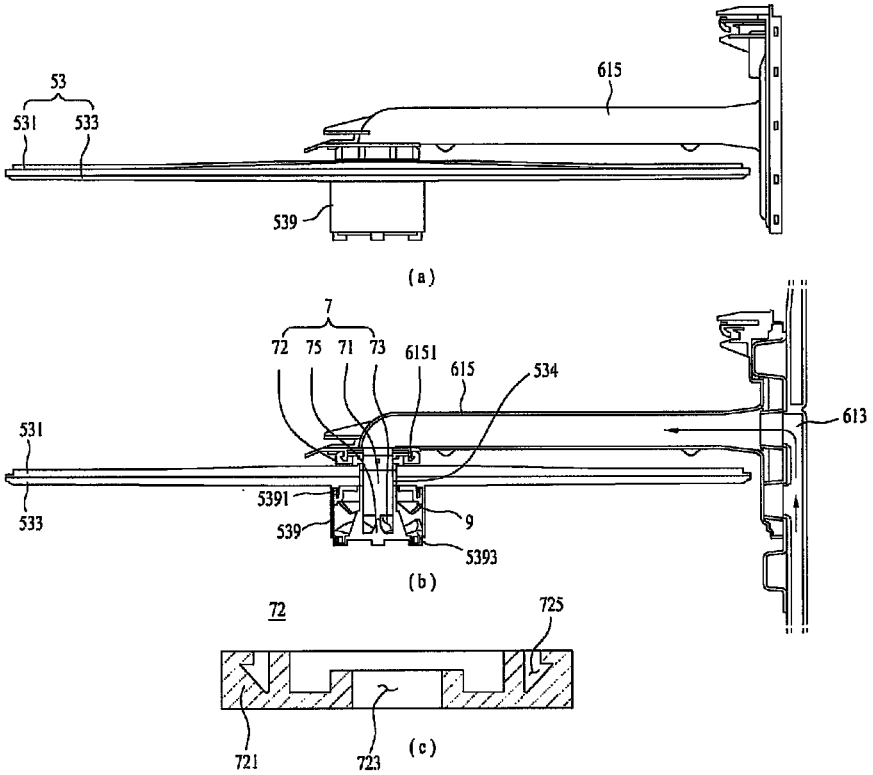

Referring to FIG. 7, the dishwasher of the present invention includes a flow passage guider 7 secured to the second chamber 539 passed through the upper arm first body 531 and the upper arm second body 533, additionally.

The flow passage guider 7 is connected to a detachable pipe 615 over the upper arm 53 for supplying the washing water to the second chamber 539.

In this case, the upper arm 53 includes a arm pass through hole 534 provided for the flow passage guider 7 to pass therethrough additionally, and, it is preferable that the upper arm supply holes 5331 are provided along an outside circumferential surface of the arm pass through hole 534 as shown in FIG. 6B.

The spray holes 5311 in the upper arm 53 may be provided such that the washing water is discharged in a vertical direction to the upper side of the upper arm first body 531, or a discharge angle of the washing water being discharged through the sprays holes 5311 is at an acute angle from the upper side of the upper arm first body 531.

If the spray holes 5311 are provided such that the discharge angle of the washing water is at an acute angle from the upper side of the upper arm first body 531, repelling power takes place when the washing water is sprayed through the spray holes. Therefore, if the upper arm 53 is rotatably provided to the detachable pipe 615, cleaning efficiency is improved since the upper arm 53 is rotatable without a separate driving unit.

In the meantime, there may be a flow passage change-over unit 9 (Called as a second flow passage change-over unit 9 to make the flow passage change-over unit 9 distinctive from the lower arm flow passage change-over unit 8) provided in the second chamber 539 to make reciprocating movement and rotating movement according to the water pressure for opening some of the plurality of upper arm supply holes 5331.

A coupling structure of the flow passage guider 7, the second chamber 539, and the second flow passage change-over unit 9 will be described with reference to FIGS. 7 to 9.

Referring to FIG. 7, the second chamber 539 is a space for supplying the washing water to the upper arm second body 533, and provided on an underside of the upper arm second body 533 to position the upper arm supply holes 5331 therein.

The flow passage guider 7 has a hollow pipe 71 having one end in communication with the detachable pipe 615, and the other end secured to an inside of the second chamber 55 passed through the upper arm 533, a detachable pipe connection unit 72 for coupling the hollow pipe 71 to the detachable pipe 615, and a discharge hole 73 for discharging the washing water from the hollow pipe 71 to the second chamber 539.

Referring to FIG. 7C, the detachable pipe connection unit 72 includes a cylindrical connection unit body 721, a pass through hole 723 provided to pass through the connection unit body for placing the hollow pipe 71 therein, and a recess 725 in the connection unit body for placing a coupling projection 6151 of the detachable pipe 615 therein.

In the meantime, the hollow pipe 71 has a flange 711 provided to an outside circumferential surface of a top side thereof having a diameter larger than a diameter of the pass through hole 723.

Since the hollow pipe 71 has one end secured to a bottom of the second chamber 539, and the other end rotatably connected to the detachable pipe connection unit 72 which is secured to the detachable pipe 615, the upper arm 53 can also be rotatably connected to the detachable pipe 615.

Figure 8:
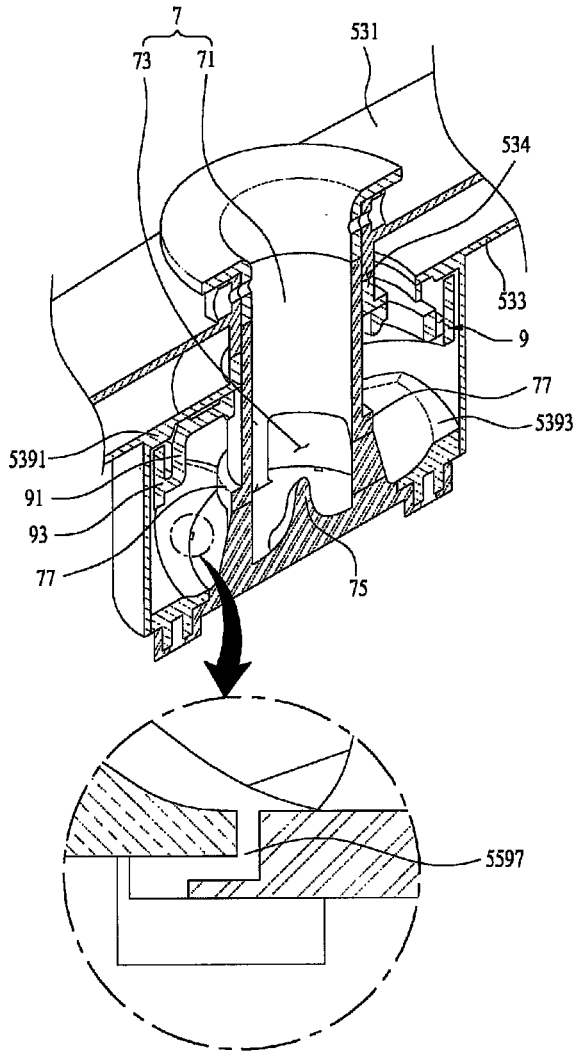

Referring to FIG. 8, the discharge hole 73 may be provided to pass through an outside circumferential surface of the hollow pipe 71.

In this case, the discharge hole 73 is positioned at a portion the hollow pipe 71 and the bottom of the second chamber 539 are connected such that the washing water being supplied through the hollow pipe 71 changes a flow direction within the second chamber 539.

Moreover, the flow passage guider 7 may include a discharge guider 75 for guiding the washing water in the hollow pipe 71 toward the discharge hole 73, additionally.

The discharge guider 75 may be provided to the bottom of the second chamber 539 in a shape of a cone with a peak point thereof positioned at a center of the hollow pipe 71.

If the discharge guider 75 is provided to have the cone shape, an oblique side of the discharge guider may be provided to have a predetermined radius of curvature.

Therefore, since the washing water in the sump pressurized by the supply pump 63 is supplied to the second chamber 539 through the second flow passage 613, the detachable pipe 615, the hollow pipe 71, and the discharge hole 73, and the washing water discharged from the hollow pipe is lead to the discharge hole 73 guided by the discharge guider 75, an impact of the washing water from the hollow pipe 71 applied to the second chamber 539 is minimized.

Because the flow passage guider 7 changes a flow direction of the washing water introduced to the hollow pipe 71 from the detachable pipe 615 within the second chamber 539, a large force is liable to be applied to the bottom of the second chamber 539 at the time the washing water is supplied to the second chamber 539. The discharge guider 75 serves to minimize the force.

And, the second chamber 539 may have a remained water drain pipe 5597 provided at the bottom thereof for removal of remained water from the inside of the second chamber.

The remained water drain pipe 5597 is provided for preventing the washing water from remaining in the second chamber 539 when operation of the dishwasher is interrupted. It is preferable that the remained water drain pipe 5597 has bends for minimizing pressure drop in the chamber when the washing water is supplied to the inside of the second chamber 539.

The second flow passage change-over unit 9 is provided such that the second flow passage change-over unit 9 moves to an upper side of the second chamber 539 (Moves toward the upper arm) if the washing water is supplied to the second chamber 539 through the hollow pipe 71 (If the water pressure in the second chamber becomes higher), and moves to the bottom of the second chamber 539 if no washing water is supplied to the second chamber 539 (If the water pressure in the second chamber becomes lower).

And, it is preferable that the second flow passage change-over unit 9 is provided such that the second flow passage change-over unit 9 rotates by a predetermined angle when the second flow passage change-over unit 9 moves toward the upper side of the second chamber 539 so as to be able to open some of the plurality of the upper arm supply holes 5331.

A structure of the second flow passage change-over unit 9 will be described in more detail with reference to FIG. 9. The second flow passage change-over unit 9 includes a cylindrical change-over unit body 91 (Hereafter called as a second change-over unit body 91 for making the change-over unit body 91 distinctive from the first flow passage change-over unit 8) having an opened side 911 (See FIG. 10B) and a closed side 913, and a body rotating unit 93 (Hereafter called as a second body rotating unit 93 for making the body rotating unit 93 distinctive from the first body rotating unit 83) for rotating the first change-over unit body 91.

The second change-over unit body 91 includes a change-over unit pass through hole 914 in the closed side 913 for placing the hollow pipe 71 therein, and channel opening holes 915 provided in the closed side 913 on an outside of the change-over unit pass through hole 914.

In this case, it is preferable that the discharge hole 73 in the flow passage guider 7 is provided to be positioned in the second change-over unit body 91 (Between the closed side of the second change-over unit body and the bottom of the second chamber).

Moreover, the flow passage guider 7 may include a change-over unit body supporting portion 77 (See FIG. 8) provided at an outside circumferential surface of the hollow pipe 71 for supporting the closed side 913 of the second change-over unit body 91, additionally.

It is preferable that the change-over unit body supporting portion 77 is positioned above the discharge hole 73 in the hollow pipe 71 for making easy moving up/down of the second change-over unit body 91 by the washing water being discharged through the discharge hole 73.

It is preferable that the channel opening holes 915 are provided to open some of the plurality of upper arm supply holes 5331 in the upper arm second body 533, only.

That is, a number of the channel opening holes 915 and a number of the upper arm supply holes 5331 may be provided different from each other. As an example, the number of the upper arm supply holes 5331 may be four provided in the second body 533 spaced at 90° intervals as shown in FIG. 6B, and the number of the channel opening holes 915 may be two provided in the second change-over unit body 91 spaced at 180° intervals as shown in FIG. 9.

The second body rotating unit 93 includes a rotating unit body 931 of a cylindrical shape with opened upper side and lower side secured to a circumferential surface of the second change-over unit body 91, upper projections 933 projected upward from the rotating unit body 931 for coupling to the second chamber upper coupling portion 5391 on the upper side of the second chamber 539, and lower projections 935 projected downward from the rotating unit body 931 for coupling to the second chamber lower coupling portion 5393 on the lower side of the second chamber 539.

The rotating unit body 931 is provided to be in contact with an inside circumferential of the second chamber 539 for guiding the reciprocating movement of the second change-over unit body 91.

The rotating unit body 931 may have a height the same with a height of the second change-over unit body 91, or the rotating unit body may have a height higher than the height of the second change-over unit body.

If the height of the rotating unit body is higher than the height of the second change-over unit body, it is preferable that the rotating unit body 931 has a top side positioned the same with a top side of the second change-over unit body 91. This is for minimizing a volume of the second chamber 539 to utilize the washing space the tub 1 provides to the maximum.

In the meantime, it is preferable that a shape of the second chamber upper coupling portion 5391 and a shape of the upper projections 933 are provided to have tooth shapes engagable to each other such that the second body rotating unit 93 is rotated by a predetermined angle when the second chamber upper coupling portion 5391 couples to the upper projections 933.

Figure 11:
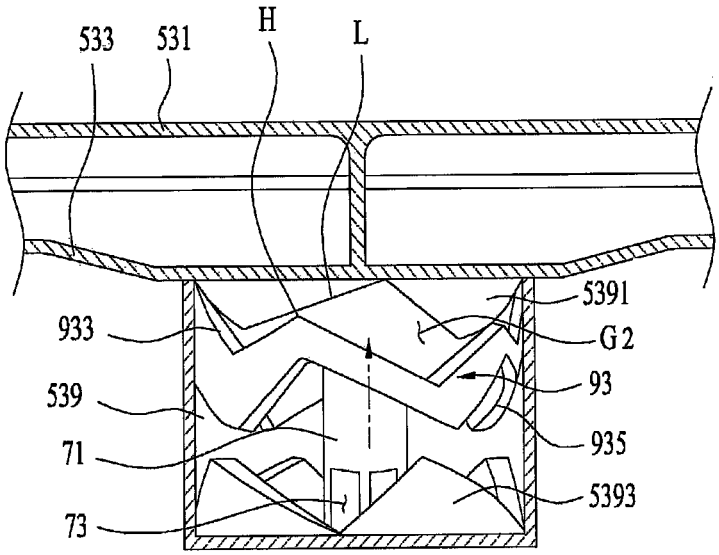

That is, referring to FIG. 11, it is preferable that the shapes of the upper projections 933 and the shape of the second chamber upper coupling portion 5391 are provided such that the second change-over unit body 91 is rotated in a course peak points H of the upper projections 933 move along oblique sides L of the second chamber upper coupling portion 5391 when the second change-over unit body 91 moves toward the second chamber upper coupling portion 5391.

Therefore, if the water pressure of an inside of the second chamber is high, the second change-over unit body 91 moves toward the upper arm 53, in which course, if the upper projections 933 couple to the second chamber upper coupling portion 5391, the second change-over unit body 91 rotates in a counter clockwise direction (Or, a clockwise direction).

It is preferable that the shape of the second chamber lower coupling portion 5393 and the shapes of the lower projections 935 also have the gear tooth shapes which are engagable to each other such that the second change-over unit body 91 is rotated in a course peak points of the lower projections 935 move along oblique lines of the second chamber lower coupling portion 5393.

Therefore, if the water pressure inside of the second chamber is low, the second change-over unit body 91 moves toward the bottom of the second chamber, in which course, the lower projections 935 couple to the second chamber lower coupling portion 5393 to rotate the second change-over unit body 91 in the counter clockwise direction (Or, the clockwise direction).

However, it is preferable that, in a case of a dishwasher having the two channel opening holes 915 spaced at 180° intervals and the four upper arm supply holes 5331 spaced at 90° intervals, the shape of the second chamber upper coupling portion 5391 and the shapes of the upper projections 933 are provided such that the second change-over unit body 91 is rotated by 45° in the counter clockwise direction when the second chamber upper coupling portion 5391 couples to the upper projections 933, and the shape of the second chamber lower coupling portion 5393 and the shape of the lower projections 935 are provided such that the second change-over unit body 91 is rotated by 45° in the counter clockwise direction when the second chamber lower coupling portion 5393 couples to the lower projections 935.

In the meantime, since the counter clockwise direction rotation of the second change-over unit body 91 is no more than a rotation direction set freely for convenience of description, shapes of the second body rotating unit 93, the second chamber upper coupling portion 5391, and the second chamber lower coupling portion 5393 may be provided to make the second change-over unit body 91 to rotate in the clockwise direction.

Figure 10:
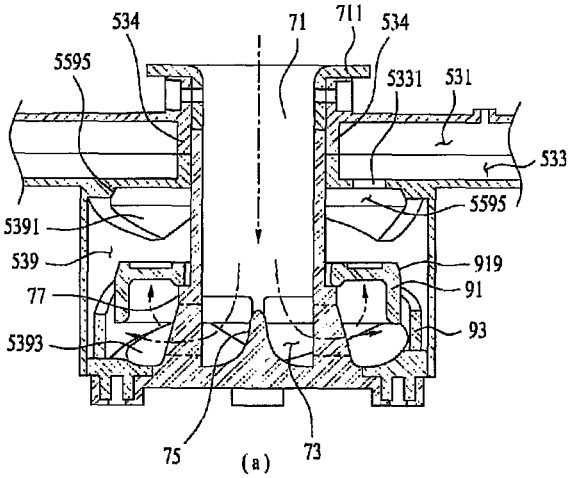
FIGS. 10 and 11 illustrate schematic views showing the steps of operation of the spray arm in FIG. 6.
Figure 10:
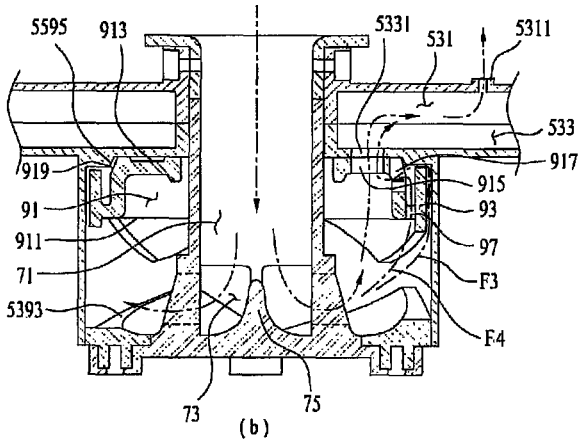

The operation of the second flow passage change-over unit 9 will be described with reference to FIG. 10, in more detail. If the washing water is not supplied to an inside of the second chamber 539 (If the water pressure in the second chamber is low), the second change-over unit body 91 maintains a coupled state to the second chamber lower coupling portion 5393 (See FIG. 10A).

However, if the washing water is introduced to the inside of the second chamber 539, the second change-over unit body 91 moves toward the upper side of the second chamber 539 guided by the hollow pipe 71, and the upper projections 933 of the second body rotating unit 93 couple to the second chamber upper coupling portion 5391.

Since the second change-over unit body 91 has a cylindrical shape with the opened side, if the washing water is supplied to the second chamber, the second flow passage change-over unit 9 will be movable, quickly.

If the upper projections 933 couple to the second chamber upper coupling portion 5391, the second change-over unit body 91 is rotated by 45° in the counter clockwise direction, and the channel opening holes 915 in the second change-over unit body 91 open some of a plurality of the upper arm supply holes 5331.

According to this, the washing water introduced to the second chamber 539 through the supply pump 63, the second flow passage 613, the detachable pipe 615 and the flow passage guider 7 will be supplied only to some of the plurality of channels 535 and 537 of the upper arm 53.

In the meantime, if the washing water supply to the second chamber is interrupted, the first change-over unit body 91 moves toward the bottom of the second chamber, and the second change-over unit body 91 rotates by 45° in the counter clockwise direction as the lower projections 935 of the second body rotating unit 93 couple to the second chamber lower coupling portion 5393.

Thereafter, if the washing water is supplied to the second chamber 539 again, the second flow passage change-over unit 9 moves toward the upper side of the second chamber 539 to open the upper arm supply holes 5331 which are not opened, before.

Therefore, the dishwasher of the present invention can improve cleaning power of the dishwasher owing to the alternated washing water spray with the plurality of channels provided to the upper arm 53, enabling to vary a spray angle of the washing water being sprayed to the washing object.

In the meantime, it is possible to provide a spray direction of the washing water from the spray holes 5311 in communication with the upper arm first channel 535 is opposite to the spray direction of the washing water from the spray holes 5311 in communication with the upper arm second channel 537, which has an effect of changing the rotation direction of the upper arm 53 when the washing water is supplied to the channels 535 and 537 alternately through the second flow passage change-over unit 9.

If it is assumed that the spray holes 5311 are provided such that the spray angle of the washing water being discharged from the spray holes 5311 is made to be at an acute angle from an upper side of the upper arm first body 531, wherein the spray holes 5311 in communication with the upper arm first channel 535 is provided to rotate the upper arm in a clockwise direction, and the spray holes 5311 in communication with the upper arm second channel 537 is provided to rotate the upper arm in a counter clockwise direction.

In this case, if the washing water is supplied to the upper arm first channel 535, the upper arm 53 rotates in the clockwise direction by repelling power of the washing water being discharged from the spray holes 5311, and if the washing water is supplied to the upper arm second channel 537, the upper arm 53 rotates in the counter clockwise direction by repelling power of the washing water being discharged from the spray holes 5311, thereby enabling the dishwasher of the present invention to vary the spray direction and the spray angle of the washing water.

In the meantime, if foreign matter remains at the second chamber or an outside circumferential surface of the second flow passage change-over unit 9, it is liable that the foreign matter interferes with the reciprocating movement and the rotating movement of the second flow passage change-over unit 9.

In order to solve such a problem, the second flow passage change-over unit 9 includes a first slit 917 for introducing the washing water F3 (See FIG. 10) flowing between the inside circumferential surface of the second chamber 539 and the outside circumferential surface of the second body rotating unit 93 to an inside of the second change-over unit body 91, additionally.

Figure 9:
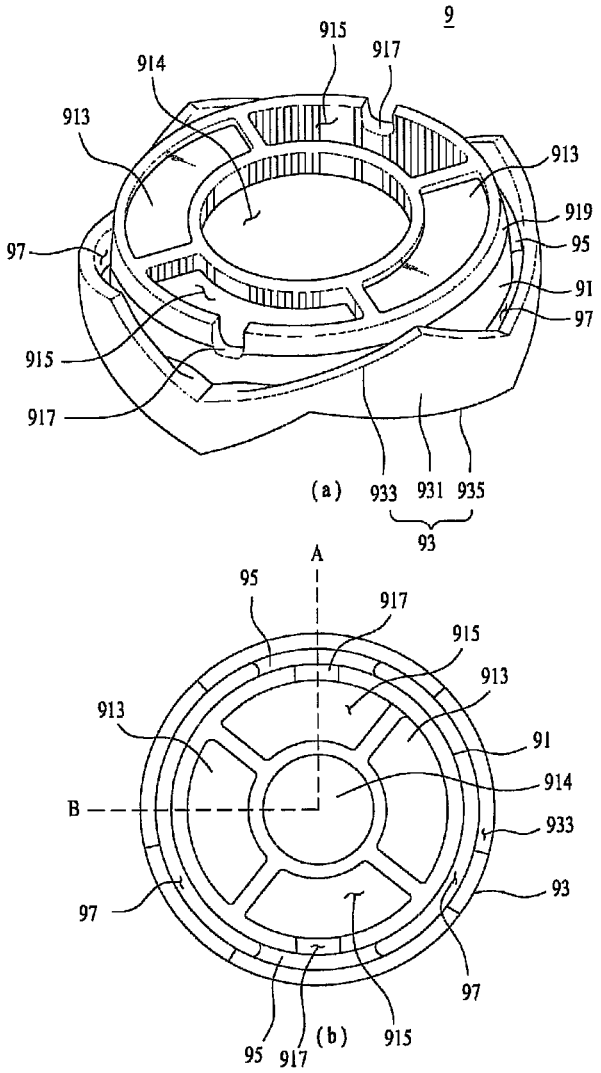
FIG. 9 illustrates schematic views of a flow passage change-over unit (First flow passage change-over unit) in the spray arm in FIG. 6.

The first slit 917 of the second flow passage change-over unit 9 may be provided passed through the outside circumferential surface of the second change-over unit body 91, or, as shown in FIG. 9, along a height direction or a circumferential direction of the second change-over unit body 91 so as to be connected to the outside circumferential surface of the channel opening holes 915.

Therefore, of the washing water supplied to the inside of the second chamber 539, the washing water F3 (See FIG. 10) flowing between the inside circumferential surface of the second chamber 530 moves to the upper arm 53 through a space G2 (See FIG. 11), the first slit 917 formed when the second chamber upper coupling portion 5391 couples to the upper projections 933.

Therefore, the dishwasher of the present invention permits to expect an effect of preventing the foreign matter contained in the washing water from remaining at the second chamber 539 or the second flow passage change-over unit 9.

In the meantime, the space G2 (See FIG. 11) between the second chamber upper coupling portion 5391 and the upper projections 933 disappears if the upper projections 933 couple to the second chamber upper coupling portion 5391 perfectly. In this case, the foreign matter is liable to remain at the inside circumferential surface of the second chamber 539 or the outside circumferential surface of the second flow passage change-over unit 9.

Therefore, a shape of the second chamber upper coupling portion 5391 and shapes of the upper projections 933 may be provided to form a space which allows a flow of the washing water even in a case the second chamber upper coupling portion 5391 couples to the upper projections 933, perfectly.

Moreover, the second flow passage change-over unit 9 may include a second slit 97 (See FIG. 9) for providing a moving space of the washing water provided between the second change-over unit body 91 and the second body rotating unit 93, additionally.

The second slit 87 may be provided as the cylindrical second body rotating unit 93 having the opened upper side and lower side is secured to the second change-over unit body 91 with a fastening rib 95.

In the meantime, it is preferable that a straight line A passing through a center of the first slit 917 and a rotation center of the second change-over unit body 91 is at a predetermined angle from a straight line B passing through a center of the second slit 97 and the rotation center of the second change-over unit body 91.

This is for making the washing water F4 to remove the foreign matter from the outside circumferential surface of the second change-over unit body 91 by making the washing water flowing through the second slit 97 to move along the circumferential surface of the second change-over unit body 91, and, therefrom, to be introduced to an inside of the second change-over unit body 91 through the first slit 917.

Moreover, the second flow passage change-over unit 9 may include a sloped side 919 additionally, and the second chamber 518 may include a second chamber sloped side 5595 for receiving the sloped side 919, additionally.

The sloped side 919 of the second flow passage change-over unit may be provided along an upper side of the second change-over unit body 91 and the second chamber sloped side 5595 may be provided to an upper side of the second chamber 539 or the second chamber upper coupling portion 5391.

And, the sloped side 919 of the second flow passage change-over unit 9 may also be provided to an outside circumferential surface of the second body rotating unit 93. In this case, it is preferable that the second chamber sloped side 5595 is provided to an upper side of an inside circumferential surface of the second chamber 539.

The sloped side 919 of the second flow passage change-over unit and the second chamber sloped side 5595 have an effect of making communication between the channel opening holes 915 and the upper arm supply holes 5331 easy if the washing water is introduced to the inside of the second chamber 539.

As has been described, the dishwasher of the present invention has the following advantages.

The present invention permits to devise an effect of providing a dishwasher of which cleaning power is improved owing to the provision of a plurality of washing water flow passages (Channels) in a spray arm which sprays the washing water.

And, the present invention permits to devise an effect of providing a dishwasher having a flow passage change-over unit for selective opening of a plurality of flow passages in a spray arm.

And, the present invention permits to devise an effect of providing a dishwasher which changes a rotation direction of a spray arm without a separate driving unit, such as a motor.

And, the present invention permits to devise an effect of providing a dishwasher which enables to remove foreign matter from a flow passage change-over unit.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A dishwasher, comprising:

a tub to provide a space to hold a washing object;

a spray arm having a plurality of channels for flow of the washing water, a plurality of supply holes to introduce the washing water to the plurality of channels, and spray holes to spray the washing water introduced to the channels thus toward the washing object;

a chamber positioned on an underside of the spray arm to communicate with the plurality of supply holes;

a flow passage guider having a first end positioned in the chamber passed through the spray arm and a second end positioned on an upper side of the spray arm;

a washing water supply connected to the second end of the flow passage guider to supply the washing water to die chamber; and a flow passage change-over provided in the chamber, wherein the flow passage change-over includes:

a change-over body having a cylindrical shape with an opened side and a closed side that makes a reciprocating movement and a rotating movement in the chamber according to a water pressure in the chamber, a change-over pass through hole in the closed side through which the flow passage guider passes, and channel opening holes in the closed side to open some of the plurality of supply holes according to a rotation angle of the change-over body.

2. The dishwasher as claimed in claim 1, wherein the chamber further includes an upper coupling portion provided at an upper side of the chamber, and a lower coupling portion provided at a lower side of the chamber, the flow passage change-over further includes a body rotator having a cylindrical shape with opened upper side and lower side, the body rotator secured to a circumferential surface of the change-over body, and the body rotator includes upper projections to be coupled to the upper coupling portion to rotate the change-over body, and lower projections to be coupled to the lower coupling portion to rotate the change over body.

3. The dishwasher as claimed in claim 2, wherein the flow passage change-over further includes:

a first slit provided to pass through the change-over body to introduce the washing water moving between an inside circumferential surface of the chamber and an outside circumferential surface of the body rotator to an inside of the change-over body.

4. The dishwasher as claimed in claim 3, wherein the flow passage change-over further includes:

a second slit provided between an outside circumferential surface of the change-over body and an inside circumferential surface of the body rotator to enable flow of the washing water.

5. The dishwasher as claimed in claim 4, wherein a straight line passing through a rotation center of the change-over body and a center of the first slit is at a predetermined angle from a straight line passing through the rotation center of the change-over body and a center of the second slit.

6. The dishwasher as claimed in claim 2, wherein the spray arm further includes an arm pass through hole passing through the flow passage guider, the plurality of supply holes is provided along a circumferential surface of the arm pass through hole, and the channel opening holes are provided along a circumferential surface of the change-over pass through hole.

7. The dishwasher as claimed in claim 6, wherein the flow passage guider includes:

a hollow pipe inserted into the area pass through hole and the change-over pass through hole, wherein the hollow pipe is connected to a bottom of the chamber; and a discharge hole provided to pass through the hollow pipe to supply the washing water to the chamber.

8. The dishwasher as claimed in claim 7, wherein the flow passage guider further includes a body support provided at an outside circumferential surface of the hollow pipe to support the change-over body to position the closed side of the change-over body to be above the discharge hole.

9. The dishwasher as claimed in claim 7, further including a discharge guider at the bottom of the chamber to guide the washing water in the hollow pipe toward the discharge hole.

10. The dishwasher as claimed in claim 9, wherein the discharge guider has a conical shape with a peak point positioned at a center of the hollow pipe.

11. The dishwasher as claimed in claim 7, further including a remaining water drain pipe provided at the bottom of the chamber to communicate an inside of the chamber with an outside chamber.

12. The dishwasher as claimed in claim 11, wherein the remaining water drain pipe has a plurality of bends.

* * * * *